US009294828B2

(12) United States Patent
Rutherford

(10) Patent No.: US 9,294,828 B2
(45) Date of Patent: Mar. 22, 2016

(54) INTEGRATED SPEAKER LIGHT FIXTURE

(71) Applicant: Richard Edward Rutherford, Camden, OH (US)

(72) Inventor: Richard Edward Rutherford, Camden, OH (US)

( * ) Notice: Subject to any disclaimer, the term of this patent is extended or adjusted under 35 U.S.C. 154(b) by 91 days.

(21) Appl. No.: 14/206,645

(22) Filed: Mar. 12, 2014

(65) Prior Publication Data

US 2015/0264458 A1 Sep. 17, 2015

(51) Int. Cl.
*H04R 1/02* (2006.01)

(52) U.S. Cl.
CPC ..... *H04R 1/028* (2013.01); *H04R 2201/021* (2013.01)

(58) Field of Classification Search
CPC .. H04R 2201/021; H04R 1/028; H04R 1/026; F21Y 2101/02; F21Y 2113/02; F21Y 2103/00
USPC ..... 381/300, 334, 394; 315/307, 309
See application file for complete search history.

(56) References Cited

U.S. PATENT DOCUMENTS

| | | | | |
|---|---|---|---|---|
| 8,042,961 | B2 * | 10/2011 | Massara et al. | 362/86 |
| 8,562,158 | B2 * | 10/2013 | Chien | F21V 19/00 362/276 |
| 2007/0110266 | A1 * | 5/2007 | Zulkowski | 381/300 |
| 2011/0068711 | A1 * | 3/2011 | Spiro et al. | 315/307 |
| 2014/0199168 | A1 * | 7/2014 | Spiro | 416/5 |

* cited by examiner

*Primary Examiner* — Brian Ensey
*Assistant Examiner* — Julie X Dang
(74) *Attorney, Agent, or Firm* — Schwegman Lundberg & Woessner, P.A.

(57) ABSTRACT

Apparatuses and a method for speaker fixture integration are provided. A speaker is integrated into a canned lighting fixture. The speaker is adapted to transmit audio in proximity to the canned lighting fixture. The audio acquired from one of: an electrical power source of the canned lighting fixture, a speaker line, and wireless audio.

19 Claims, 4 Drawing Sheets

INTEGRATED SPEAKER LIGHT FIXTURE

BACKGROUND

Consumers have a variety of options these days for playing music or audio. Audio systems are now small enough that they can get lost in someone's pocket and large enough that they can occupy an entire room. Moreover, composite devices have integrated speakers and a wide variety of audio options for a consumer.

One issue with home-based audio delivery is that most systems require yet more independent devices that must be placed in the home somewhere and connected to an electrical outlet. The location of outlets may not be convenient given the existing configuration of a home, and placement of the audio device(s) may impact performance and quality of the audio device and the delivered sound.

Typically, consumers do not build their own homes so as to dictate the placement of audio wiring and audio wall jacks. Even when consumers do build their own homes and have the foresight to prewire the home for audio systems, they often lack the clairvoyance to determine how furniture, audio systems, and televisions will be placed in the home, such that even prewired homes for audio can be impractically preconfigured for the lifestyles of the consumers.

Thus, there is a need for improved audio integration and delivery in homes and work places of consumers.

SUMMARY

Various embodiments of the invention provide apparatuses and a method for speaker fixture integration. In an embodiment, a speaker fixture integration apparatus is presented.

Specifically, and in one embodiment, an apparatus is provided. The apparatus includes a canned lighting fixture and a speaker. The speaker is integrated into the canned lighting fixture, and the speaker is adapted to deliver audio while a light bulb is coupled to the canned lighting fixture.

DETAILED DESCRIPTION

Figure 1:
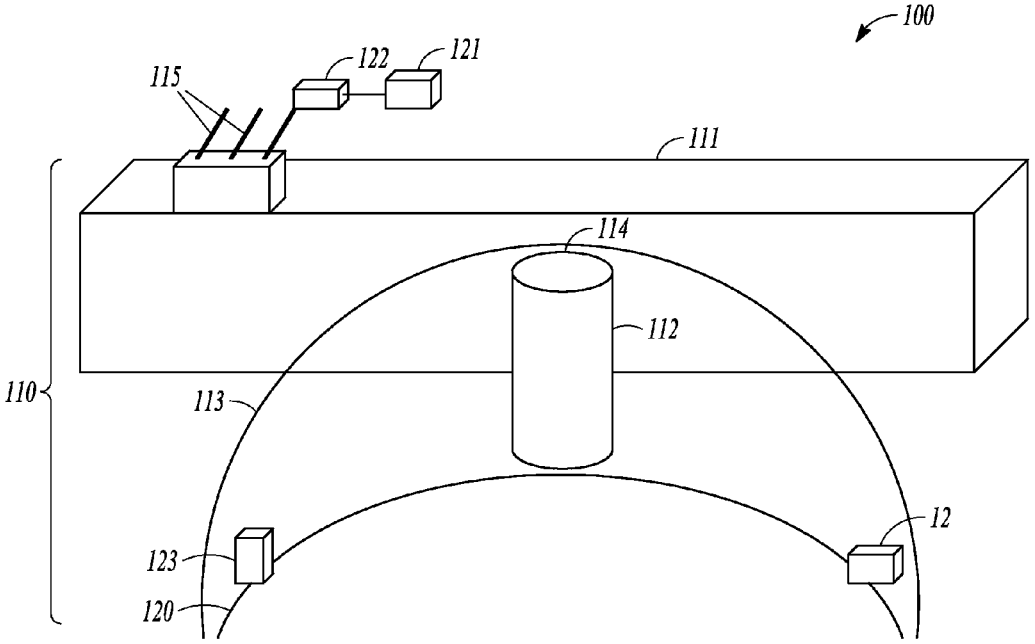
FIG. 1 is a diagram of a speaker fixture integration apparatus, according to an example embodiment presented herein.

FIG. 1 is a diagram of a speaker fixture integration apparatus 100, according to an example embodiment presented herein. The diagram is presented for purposes of illustration only and is not intended to limit embodiments of the invention to just the configuration detailed in the FIG. 1.

For example, many configurations of canned lighting fixtures exist beyond the configuration shown in the FIG. 1, and any such configuration for a basic canned lighting fixture can be used with the integrated speaker approach discussed herein and below.

Moreover, the components of a canned lighting fixture and basic components of a speaker are known to those of ordinary skill in the art and need not be recited for making and using the novel apparatuses and method discussed herein and below.

Thus, basic components of a canned lighting fixture and a speaker are not depicted in the FIG. 1; that is, only the components necessary for a complete understanding of the embodiments of the invention are depicted in the FIG. 1.

The speaker fixture integration apparatus 100 includes a canned lighting fixture 110 and a speaker 120.

The canned lighting fixture 110 includes a housing 111 having a fixture socket 112 for receiving a light bulb. The housing 111 also includes a recessed cone 113 having an apex 114 where the fixture socket 112 is situated. Furthermore, the housing 111 includes an electrical box having electrical power connection cords 115.

In an embodiment, the canned lighting fixture 110 includes a speaker wire 115 for connecting to speaker wire that runs to the housing 111 for connection to the speaker wire 115.

The speaker fixture integration apparatus 100 also includes a speaker 120. The speaker is integrated into the canned lighting fixture 110. This integration can occur in a number of manners.

For example, the housing 111 can be prefabricated with the speaker 120 such that the housing 111 and the speaker are one integrated unit.

In another case, the speaker 120 is an independent and separate unit from the housing 111 and adapted to be integrated into the housing (such embodiment is depicted and discussed in greater detail with reference to the FIG. 2 below).

According to an embodiment, the speaker 120 includes a wireless receiver 121 that is integrated into the speaker (the location of the wireless receiver 121 is adjustable and the depiction of its location within the speaker is presented for illustration only). The wireless receiver 121 adapted to receive wireless audio in a variety of formats, such as, but not limited to: Bluetooth, Low Energy Bluetooth, Radio Frequency (RF), Infrared (IR), WiFi, and the like.

In an embodiment, the speaker 120 includes a port 122.

According to an embodiment, the port 122 is adapted to receive a connection to a wireless receiver 121 for receiving audio outputted by that wireless receiver 121. So, the speaker 120 can be adapted to interface to a modular and independent wireless receiver 121 that utilizes a variety of available audio delivery output mechanisms of the wireless receiver 121 through the port 122.

In an embodiment, the port 122 is integrated into the housing 111 and wired to the speaker 120. In an embodiment, the port 122 is independent of the housing 111 (such as when the speaker 120 is also an independent and separate unit from the housing 111). In an embodiment, the port is adapted to receive audio from a device associated with a transmission line, where that transmission line is coupled to the device on one end of the transmission line and the other end of the transmission line is connected to the port 122. This permits audio to be delivered from the device to the speaker 120 utilizing the port 122.

The port 122 is one of: Ethernet, Universal Serial Bus (USB), Coaxial Cable, phone port, speaker connection ports (e.g., right speaker, left speaker, etc.), and other port interfaces.

In an embodiment, the speaker 120 includes a battery compartment 123 adapted to receive a battery and provide power (battery-based power source) to the speaker 120 (and, perhaps, any wireless receiver 121 that may be integrated into the speaker 120.

According to an embodiment, the speaker 120 is a cone shape and includes an apex on a top end of the cone shape speaker 120. The speaker 120 adapted (in shape and size) to fit inside the recessed circular cone 113 of the speaker 120.

In an embodiment, where the speaker 120 is a separate independent unit from the housing 111, the apex of the speaker 120 includes a threaded power connector (shown in the FIG. 2 below). The speaker 120 adapted to integrate into housing 111 by screwing the threaded power connector into the fixture socket 112 that is normally designed to receive a light bulb into the housing 111. In an embodiment, the apex of the speaker 120 also includes a receptacle on an underside of the threaded power connector to receive a light bulb. So, the speaker 120 can be integrated into the housing 111 as an insert by screwing the insert into the light socket 112 of the housing 111 at the apex 114 of the housing 111.

In an embodiment, the apex of the speaker 120 includes a hollow ring such that a connecting end of a light bulb (when screwed into the fixture socket 112 of the housing 111) passes through the hollow ring and affixes the speaker 120 to the housing 111 at the fixture socket 112.

The speaker 120 is adapted to receive a variety of audio formats and transmit that audio out in proximity to the location of the canned lighting fixture 110.

In an embodiment, the speaker 120 is adapted to acquire or obtain the audio formats over a power line coupled to the canned lighting fixture 110. That is, the same power line that powers the canned lighting fixture 110 to supply power for illuminating a light bulb is used to deliver audio from an audio source to the speaker 120 for the speaker 120 to play or transmit out audio in proximity to the canned lighting fixture 110.

In an embodiment, the speaker 120 is adapted to acquire the audio through a speaker line interfaced on one end to an audio source and on the other end to the speaker 120 (such as though a speaker line, which can be any transmission line capable of delivering audio formats over that transmission line (some of which were enumerated above with discussing port 122)).

In an embodiment, the speaker 120 is adapted to acquire power from the power source of the housing 111 (such as through the power transmission lines connected to the power connection cords 115).

Figure 2:
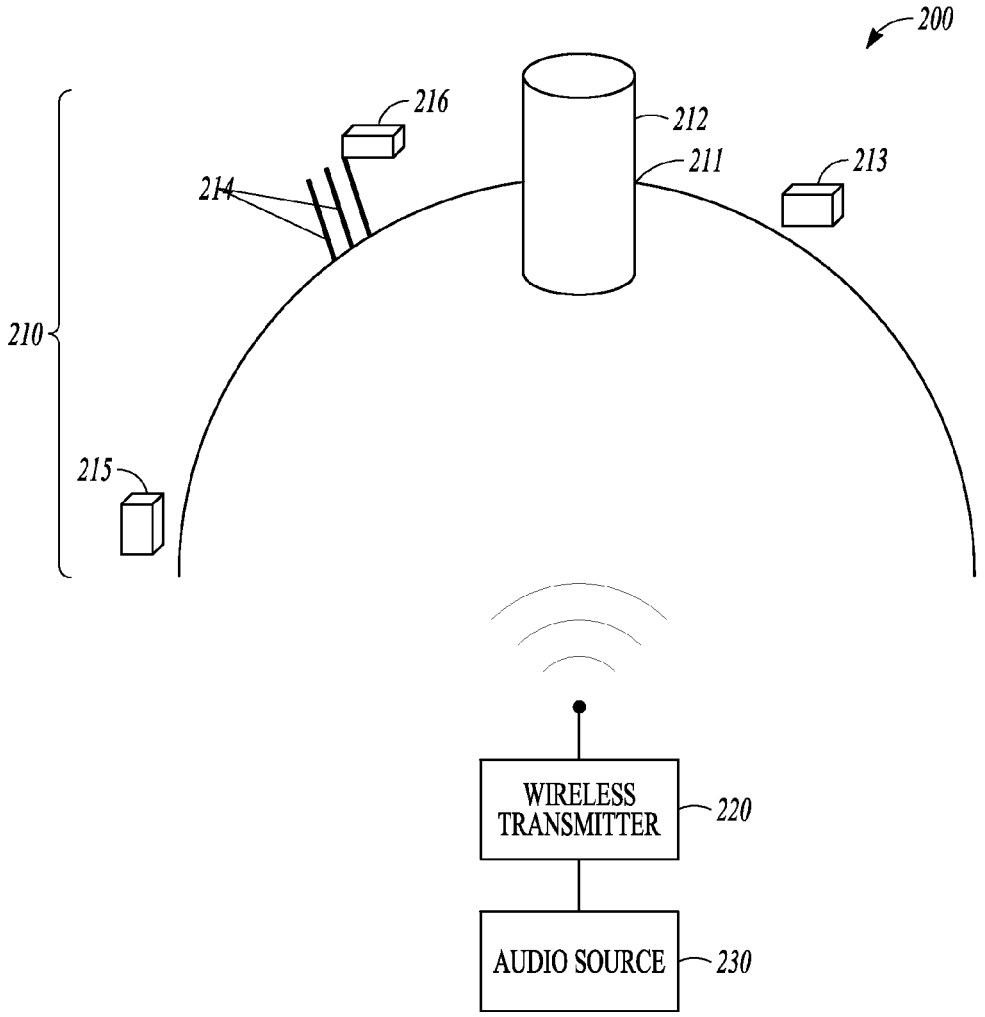
FIG. 2 is a diagram of another speaker fixture integration apparatus, according to an example embodiment.

FIG. 2 is a diagram of another speaker fixture integration apparatus 200, according to an example embodiment. The diagram is presented for purposes of illustration only and is not intended to limit embodiments of the invention to just the configuration detailed in the FIG. 2.

For example, many different sizes and shapes for the configurations speaker fixture integration apparatus 200 are conceivable beyond the configuration shown in the FIG. 2, and any such configuration for speaker fixture integration apparatus 200 can be used as embodiments of the speaker fixture integration apparatus 200 presented herein.

Moreover, the basic components of a speaker are known to those of ordinary skill in the art and need not be recited for making and using the novel apparatuses and method discussed herein and below.

Thus, basic components of a speaker are not depicted in the FIG. 2; that is, only the components necessary for a complete understanding of the embodiments of the invention are depicted in the FIG. 2.

The speaker fixture integration apparatus 200 includes a ring shaped speaker 210 adapted in size and shape to insert into a recessed cone of a canned lighting fixture, the apex of the recessed circular cone having a socket for receiving a light bulb.

The ring shaped speaker 210 includes an apex 211 and, optionally, a threaded component 212. The ring shaped speaker 210 may also include a power connector 214, a battery compartment 215, and/or a port interface 216. The underside and inside of the threaded component hollowed and threaded for receiving a light bulb.

In an embodiment, the apex 211 includes the threaded component 212. The threaded component 212 adapted to screw into a canned lighting fixture socket of a canned lighting fixture. This integrates the ring shaped speaker 210 into the canned lighting fixture at the canned lighting fixture socket.

In an embodiment, the apex 211 includes a hollow ring adapted for a light bulb connector piece to pass through the hollow ring and integrate the ring shaped speaker 210 into a canned lighting fixture when the light bulb is screwed into the canned lighting fixture socket.

In an embodiment, the ring shaped speaker 210 includes power connector cords 214 for supplying Alternating Current (AC) power to the ring shaped speaker 210. The power connector cords 214 adapted to be tied or coupled to the power line of the canned lighting fixture. So, in this embodiment, the ring shaped speaker 210 shares the same power source as the canned lighting fixture.

In an embodiment, the ring shaped speaker 210 includes a battery compartment 215 for supplying Direct Current (DC) power to the ring shaped speaker 210. In this case, the ring shaped speaker 210 has its own independent power supply from that which is associated with the canned lighting fixture.

In an embodiment, the ring shaped speaker 210 includes a wireless receiver 213. The wireless receiver 213 adapted for receiving audio in a wireless format from a wireless transmitter. The types of wireless audio formats were discussed above with reference to the FIG. 1. In an embodiment, the speaker fixture integration apparatus 200 also includes the wireless transmitter 220. The wireless transmitter 220 connected to an audio source 230 (any device or system capable of providing audio). The wireless transmitter 220 adapted to transmit wireless audio to the wireless receiver 213.

In an embodiment, the ring shaped speaker 210 includes a port interface 216. The port interface 216 can be used to couple the audio source 230 to the ring shaped speaker 210 or couple the port interface 216 to the wirelessly receiver 213. The types of port interfaces 216 were discussed at length above with the reference to the FIG. 1. Moreover, a although the FIG. 2 shows a particular placement where the port interface 216 is situated within or on the ring shaped speaker 210, it is noted that other locations are permissible as well, without departing from the teachings presented herein.

The ring shaped speaker 210 is adapted to receive audio or audio encoded format transmissions and transmit or play that audio out the ring shaped speaker 210 in proximity to the canned lighting fixture.

In an embodiment, the ring shaped speaker 210 acquires or obtains the audio over the power line of the canned lighting fixture (which also supplies power to the ring shaped speaker 210).

In an embodiment, the ring shaped speaker 210 acquires or obtains the audio over a speaker transmission line (Ethernet, speaker wire, USB, coaxial cable, etc.).

In an embodiment, the ring shaped speaker 210 acquires or obtains the audio over a wireless transmission, such as through any wireless transmission mentioned above with respect to the FIG. 1. The wireless transmission received by the wireless receiver 213.

Figure 3:
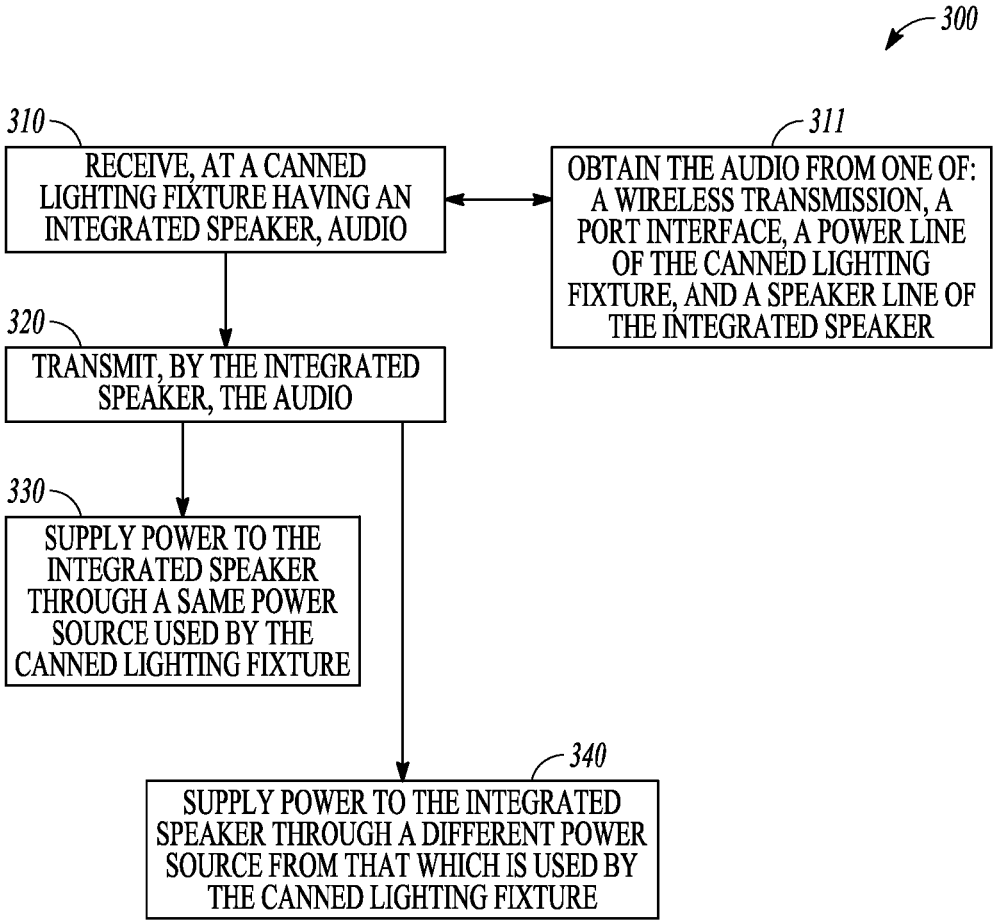
FIG. 3 is a diagram of a method for operating a speaker fixture apparatus, according to an example embodiment.

FIG. 3 is a diagram of a method for operating a speaker fixture apparatus, according to an example embodiment.

In an embodiment, the speaker fixture apparatus is the speaker 120 of the FIG. 1.

In an embodiment, the speaker fixture apparatus is the ring shaped speaker 210 of the FIG. 2.

At 310, audio is received at a canned lighting fixture having an integrated speaker.

According to an embodiment, at 311, the audio is obtained, by the integrated speaker, from one of: a wireless transmitter, a power line of the canned lighting fixture, a port interface, and a speaker line (any audio-capable transmission line) associated with the integrated speaker. The mechanisms for achieving each of these were discussed above in detail with reference to the FIGS. 1-2.

At 320, the audio is transmitted by the integrated speaker in the vicinity and proximity to the canned lighting fixture.

According to an embodiment, at 330, power is supplied to the integrated speaker through a same power source used by the canned lighting fixture.

In an embodiment, at 340, power is supplied to the integrated speaker through a different power source from that which is used by the canned lighting fixture (such as via battery, different electrical power source, solar, etc.).

Figure 4:
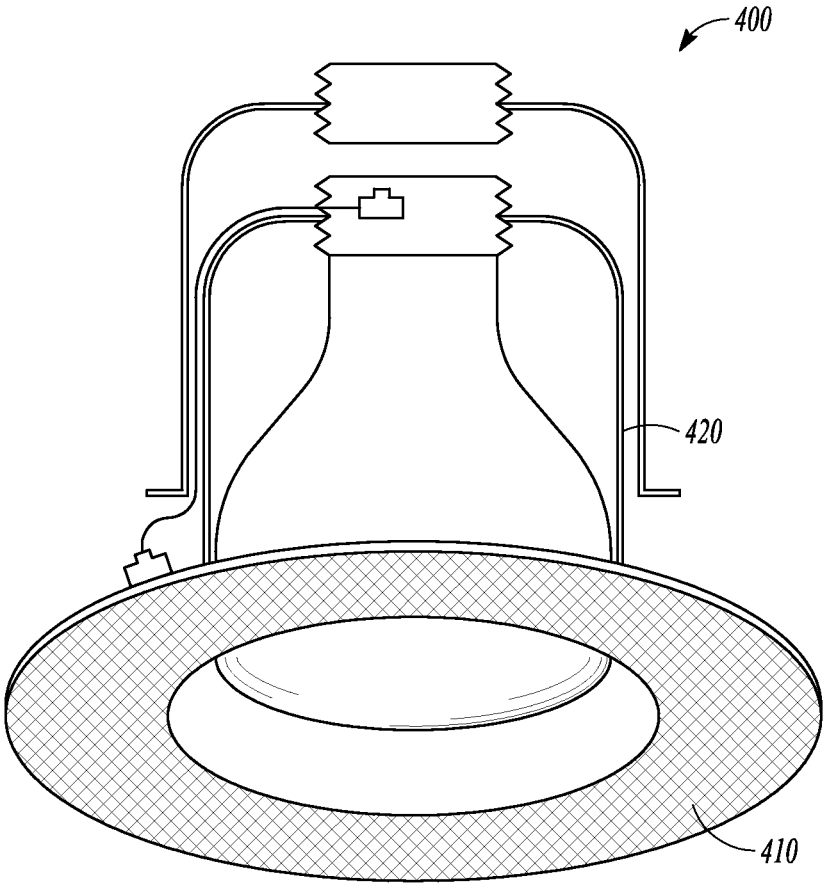
FIG. 4 is a diagram of still another speaker fixture integration apparatus, according to an example embodiment.

FIG. 4 is a diagram 400 of still another speaker fixture integration apparatus, according to an example embodiment. The diagram 400 is presented for purposes of illustration only and is not intended to limit embodiments of the invention to just the configuration detailed in the FIG. 4.

The apparatus includes a canned light fixture 420 and an integrated speaker 410. The speaker 410 is attachable to the canned light fixture 420 via a spring latch mechanism that keeps the speaker 410 at the base of the canned light fixture 420.

The speaker 410 is a ring shape having a hole that permits a light of the canned light fixture 420 to be removed and screwed into the canned light fixture 420. The speaker 410 provides a perimeter area on a ceiling for the canned light fixture 420. Moreover, the speaker 410 is removable without removing the canned light fixture 420.

All the previous mechanisms for acquiring power and sound at the speaker 410 can be used in this embodiment as well.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

The invention claimed is:

1. An apparatus, comprising: a canned lighting fixture; and a speaker integrated into the canned lighting fixture as one unit, the speaker adapted to deliver audio from the canned lighting fixture, and wherein the ring shaped speaker attachable to and removable from the canned lighting fixture through a spring latch mechanism.

2. The apparatus of claim 1, wherein the speaker is adapted to acquire the audio over a power line coupled to the canned lighting fixture.

3. The apparatus of claim 1, wherein the speaker is adapted to acquire the audio through a speaker line coupled to the canned lighting fixture.

4. The apparatus of claim 1 further comprising, a wireless receiver integrated into the speaker, the wireless receiver adapted to receive wireless audio that is transmitted out the speaker as the audio.

5. The apparatus of claim 1 further comprising, a power connector adapted to couple to a power line to supply power to a light bulb and the speaker.

6. The apparatus of claim 1 further comprising, a battery connector adapted to receive a battery and supply power to the speaker.

7. The apparatus of claim 1, wherein the speaker surrounds a recessed circular cone of the canned lighting fixture.

8. An apparatus, comprising: a ring shaped speaker adapted to insert in a recessed circular cone of a canned lighting fixture, an apex of the recessed circular cone of the canned lighting fixture having a socket for receiving a light bulb, and wherein the ring shaped speaker attachable to and removable from the canned lighting fixture through a spring latch mechanism.

9. The apparatus of claim 8, wherein the apex includes a threaded power connector adapted to screw into a canned lighting fixture socket of the canned lighting fixture.

10. The apparatus of claim 8, wherein the ring shaped speaker is adapted to deliver audio acquired over a power line coupled to the canned lighting fixture, the ring shaped speaker adapted to transmit the audio.

11. The apparatus of claim 8, wherein the ring shaped speaker is adapted to deliver audio acquired through a speaker line coupled to the ring shaped speaker, the ring shaped speaker adapted to transmit the audio.

12. The apparatus of claim 8 further comprising, a wireless receiver integrated into the ring shaped speaker adapted to receive wireless audio that is transmitted out the ring shaped speaker as audio.

13. The apparatus of claim 12 further comprising, a wireless transmitter adapted to couple to an audio source, and the wireless transmitter adapted to wirelessly transmit the wireless audio to the wireless receiver.

14. The apparatus of claim 8 further comprising, a power connector integrated into the ring shaped speaker, the power connector adapted to couple to a power line of the canned lighting fixture to supply power to the ring shaped speaker.

15. The apparatus of claim 8 further comprising, a battery connector integrated into the ring shaped speaker, the battery connector adapted to receive a battery and supply power to the speaker.

16. A method, comprising: receiving, at a canned lighting fixture having an integrated speaker that is integrated within the canned lighting fixture as one unit, audio; and transmitting, by the integrated speaker, the audio, and wherein the ring shaped speaker attachable to and removable from the canned lighting fixture through a spring latch mechanism.

17. The method of claim 16, wherein receiving further includes obtaining the audio from one of: a wireless transmitter, a power line of the canned lighting fixture, and a speaker line of the integrated speaker.

18. The method of claim 16 further comprising, supplying power to the integrated speaker through a same power source used by the canned lighting fixture.

19. The method of claim 16 further comprising, supplying power to the integrated speaker through a different power source from that which is used by the canned lighting fixture.

* * * * *